US006713432B2

(12) United States Patent
Ikemizu et al.

(10) Patent No.: US 6,713,432 B2
(45) Date of Patent: Mar. 30, 2004

(54) THERMAL TRANSFER RECORDING MATERIAL AND THERMAL TRANSFER RECORDING METHOD

(75) Inventors: Dai Ikemizu, Hino (JP); Mitsuhiro Fukuda, Hino (JP); Motoaki Sugino, Hino (JP); Norio Miura, Hino (JP)

(73) Assignee: Konica Corporation (JP)

( * ) Notice: Subject to any disclaimer, the term of this patent is extended or adjusted under 35 U.S.C. 154(b) by 68 days.

(21) Appl. No.: 10/058,581

(22) Filed: Jan. 28, 2002

(65) Prior Publication Data

US 2002/0151437 A1 Oct. 17, 2002

(30) Foreign Application Priority Data

Feb. 8, 2001 (JP) ..... 2001-032618

(51) Int. Cl.[7] ..... B41M 5/00

(52) U.S. Cl. ..... 503/227; 106/31.47; 106/31.49; 156/235; 428/32.1; 428/32.6; 428/195.1; 430/48

(58) Field of Search ..... 8/471; 503/227; 106/31.47, 31.49; 156/235; 428/32.1, 32.6, 195.1; 430/48

(56) References Cited

U.S. PATENT DOCUMENTS

| | | | | |
|---|---|---|---|---|
| 4,824,485 | A | 4/1989 | Tanaka et al. | 106/22 |
| 5,358,922 | A | 10/1994 | Nakayama et al. | 503/227 |

FOREIGN PATENT DOCUMENTS

| | | |
|---|---|---|
| EP | 423796 | 4/1991 |
| EP | 0763569 | 3/1997 |
| JP | 2178088 | 11/1990 |
| JP | 3143684 | 6/1991 |
| JP | 3143686 | 6/1991 |
| JP | 1178258 | 3/1999 |
| JP | 108525 | 4/2000 |
| JP | 185476 | 7/2000 |
| JP | 255171 | 9/2000 |
| JP | 31896 | 2/2001 |

OTHER PUBLICATIONS

European Search Report EP 02 00 2209.
Patent Abstracts of Japan, Publication #03143686, publication date Jun. 19, 1991—1 page of English Abstract.

*Primary Examiner*—B. Hamilton Hess
(74) *Attorney, Agent, or Firm*—Muserlian, Lucas and Mercanti

(57) ABSTRACT

A thermal transfer recording material comprising a support having thereon an image transferring layer containing a coloring material represented by Formula (I), Formula (I):

Formula (I):

wherein each $R_{11}$ and $R_{12}$ is independently a substituted or unsubstituted aliphatic group; $R_{13}$ is a substituent and n is an integer of 0 to 4, provided that when n is 2 or more, a plurality of $R_{13}$s are the same or different; $R_{14}$ is an alkyl group; and each $R_{15}$ and $R_{16}$ is independently an alkyl group having 3 to 8 carbon atoms.

6 Claims, 1 Drawing Sheet

THERMAL TRANSFER RECORDING MATERIAL AND THERMAL TRANSFER RECORDING METHOD

FIELD OF THE INVENTION

The present invention relates to a thermal transfer recording material, a thermal transfer recording method, an ink, a toner, and a color filter utilizing specified dyes.

BACKGROUND OF THE INVENTION

Heretofore, there have been investigated many color image recording methods in order to prepare color hard copies. Examples of these are ink jet, electrophotography, thermal transfer, and silver halide photographic materials. Of these, thermal transfer recording exhibits advantages such as ease of operation and maintenance, and having the possibility to decrease the dimensions of the apparatus and running cost for printing.

In said thermal transfer recording, coloring materials employed in thermal transfer recording materials (hereinafter occasionally referred to as thermal transfer materials) are critical components. With the purpose of improving the stability of formed images, especially to improve fixability and light fastness of images, thermal transfer materials and image forming methods were disclosed. Examples of these are, Japanese Patent Publication Open to Public Inspection Nos. 59-78893, 59-109349, and 60-2398. Images formed employing thermally transferred dyes capable of being chelated (which are called post-chelate dyes or metal chelate dyes in the present specification), disclosed in said patent publications, exhibit excellent light fastness and excellent fixability. However, the sensitivity of thermal transfer materials and storage stability of the materials themselves does not meet full satisfaction. In addition, when full-color images are prepared using post-chelate dyes, it has been necessary to improve the color reproduction due to the following reason. When the chelate reaction does not fully proceed, the absorption of unreacted post-chelate dyes becomes observable due to the great color difference between the post-chelate dyes and unreacted dyes, and in addition, the post-chelate dyes sometimes exhibits undesirable absorption to obtain a desirable full-color image.

Specifically, Japanese Patent Publication Open to Public Inspection Nos. 3-143684, 3-143686, and 9-257947, and Japanese Patent Application No. 11-60123 describe thermal transfer recording materials employing dyes comprising a pyrazolopyrimidine-7-one parent nucleus. These dyes to some extent overcome the problems as mentioned above, but their improvement has been insufficient. Specifically, storage stability at high temperature and high humidity (heat and moisture resistance) and storage stability under light illumination (light fastness) has been insufficient, and consequently further improvement has been demanded.

Further, said metal chelate dyes, when employed in an ink for ink jet printing, are required to result in compatibility with several recording systems (such as 1: a system which press-ejects liquid droplets utilizing electromechanical conversion of a piezo element, 2: a system which press-ejects droplets while generating air bubbles utilizing electrothermal conversion, and 3: a system which suck-ejects liquid droplets utilizing electrostatic force), high recording density and excellent image color, excellent image stability such as light fastness, heat resistance and water resistance, rapid fixing onto the media to be recorded and no bleeding after recording, excellent stability as ink, no problem regarding safety, and low cost. From such viewpoints, various types of ink jet recording liquid have been proposed and investigated. However, the types of recording liquid, which satisfy most of demands at the same time, are extremely limited. In color image recording, employing yellow, magenta, cyan, and black, a variety of dyes and pigments, having C.I. number, which are indicated in Color Index and conventionally known in the art, have been investigated. However, there are still needed further efforts to improve the properties of dyes such as durability, light fastness, and spectral absorption characteristics in terms of color reproduction which results in high color vividness.

Further, when said dyes are employed in color toners, in color copiers and color laser printers employing an electrophotographic system, toner, which is prepared by dispersing colorants into resinous particles or by adhering colorants onto the surface of resinous particles, is generally employed. When the method in which colorants are adhered onto the surface of resinous particles is employed, it is difficult to achieve sufficient coloring effects due to coloration of only the surface. Further, problems occur in which due to releasing of colorants from the surface, charging properties vary and the surface of fixing rollers is stained. Due to that, toner, which is prepared by dispersing said colorants into the interior of particles, is increasingly being employed. Listed as performance required for said toner are color reproduction and image transparency and light fastness when employed for overhead projectors (hereinafter referred to as OHP). Japanese Patent Publication Open to Public Inspection Nos. 62-157051, 62-255956 and 6-118715 disclose toners which are prepared by dispersing pigments as colorants into particles. The resultant toners exhibit good light fastness, but tend to coagulate due to the fact that the pigments are insoluble. As a result, problems such as a decrease in transparency and color variation have occurred. On the other hand, Japanese Patent Publication Open to Public Inspection Nos. 3-276161, 2-207274, and 2-207273 disclose toners in which dyes are employed as colorants. The resultant toners result in high transparency and no color variation, but results in problems with light fastness.

Still further, high transparency is required for color filters, whereby a method called the dying method has been practiced in which coloration is performed employing dyes. For example, it is possible to produce color filters employing the following steps. Photosensitive materials, which are subjected to dying, are applied onto a substrate such as glass, and subsequently, pattern exposure of one of said filter colors is carried out. The unexposed part is washed off in the development process, and the remaining pattern part is dyed employing the dye for said filter color. This operation is successively repeated for all other filter colors. This method results in color filters with excellent optical properties due to high transparency obtained by using dyes. However, light fastness and heat resistance has been limited. As a result, instead of dyes, organic pigments, which exhibit excellent light fastness and heat resistance, have been employed. However, it has been difficult to produce pigment-employed filters which exhibit the optical properties obtained by dye-employed filters.

It is desirable that said dyes, which can be used for each use, are provided with the following properties in common. Namely, listed as requirements are preferable color for color reproduction, optimal spectral absorption properties, high image durability such as light fastness, heat resistance, water resistance, and chemical resistance, and a high molar absorption coefficient.

SUMMARY OF THE INVENTION

An object of the present invention is to provide a thermal transfer recording material to prepare images which exhibit high sensitivity, excellent color reproduction, and excellent image retaining quality, and a thermal transfer recording method using said recording material. Another object of the present invention is to provide an ink jet recording ink which exhibits optimal spectral absorption characteristics, and high image durability which are suitable for use. Another object of the present invention is to provide a color toner and a color filter having optimal spectral absorption characteristics, and high image durability.

The inventors of the present invention performed diligent investigations to overcome said problems. As a result, it was discovered that the objects of the present invention were achieved by employing novel dyes having a pyrazolopyrimidine-7-one parent nucleus.

Namely, aforesaid objects of the present invention are achieved employing the embodiments described below.

1. A thermal transfer recording material comprising a support having thereon an image transferring layer containing a coloring material represented by Formula (I), Formula (I):

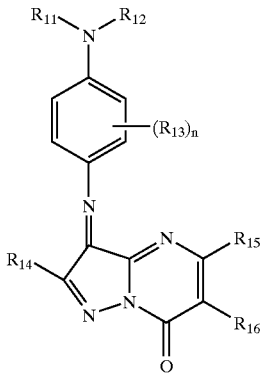

wherein each $R_{11}$ and $R_{12}$ is independently a substituted or unsubstituted aliphatic group; $R_{13}$ is a substituent and n is an integer of 0 to 4, provided that when n is 2 or more, a plurality of $R_{13}$s are the same or different; $R_{14}$ is an alkyl group; and each $R_{15}$ and $R_{16}$ is independently an alkyl group having 3 to 8 carbon atoms.

2. The thermal transfer recording material of item 1, wherein $R_{14}$ is a secondary alkyl group.
3. The thermal transfer recording material of item 1, wherein the coloring material is represented by Formula (II), Formula (II):

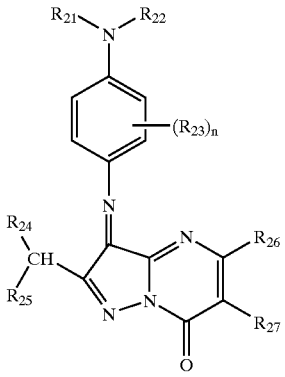

wherein each $R_{21}$ and $R_{22}$ is independently a substituted or unsubstituted aliphatic group; $R_{23}$ is a substituent and n is an integer of 0 to 4, provided that when n is 2 or more, a plurality of $R_{23}$s are the same or different; $R_{24}$ and $R_{25}$ each are an alkyl group; $R_{26}$ is a branched chain alkyl group; and $R_{27}$ is an alkyl group other than methyl group.

4. The thermal transfer recording material of item 3, wherein $R_{26}$ is a branched chain alkyl group having 3 to 8 carbon atoms.
5. The thermal transfer recording material of item 3, wherein the coloring material represented by Formula (II) has a molecular weigh of 400 to 500.
6. A thermal transfer recording method, comprising the steps of:
   (a) superimposing an image receiving material onto a thermal transfer recording material comprising a support having thereon an image transferring layer containing a coloring material represented by Formula (I) or Formula (II),
   (b) applying heat onto the thermal transfer recording material to form an image; and
   (c) separating the thermal transfer recording material and the image receiving material from each other, Formula (I):

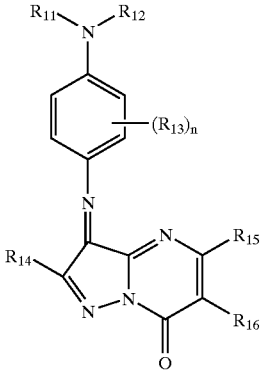

wherein each $R_{11}$ and $R_{12}$ is independently a substituted or unsubstituted aliphatic group; $R_{13}$ is a substituent and n is an integer of 0 to 4, provided that when n is 2 or more, a plural $R_{13}$s are the same or different; $R_{14}$ is an alkyl group; and each $R_{15}$ and $R_{16}$ is independently an alkyl group having 3 to 8 carbon atoms, Formula (II):

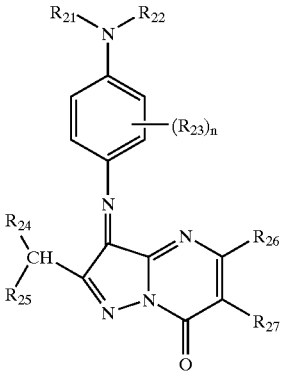

wherein each $R_{21}$ and $R_{22}$ is independently a substituted or unsubstituted aliphatic group; $R_{23}$ is a substituent and n is an integer of 0 to 4, provided that when n is 2 or more, a plurality of $R_{23}$s are the same or different; $R_{24}$ and $R_{25}$ each are an alkyl group; $R_{26}$ is a branched chain alkyl group; and $R_{27}$ is an alkyl group other than methyl group.

7. The thermal transfer recording method of item 6, wherein the image receiving material comprises a support having thereon a layer containing a compound comprising a metal ion capable of forming a metal complex dye with the coloring material in the thermal transfer recording material during the step (b).
8. An ink for ink jet printing, which comprises a metal complex dye prepared from a compound containing a metal ion and a coloring material represented by Formula (I) or Formula Formula (I):

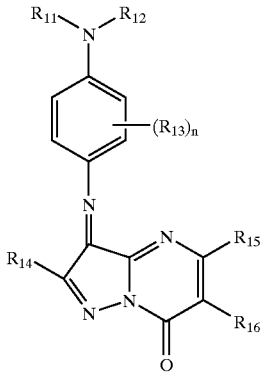

wherein each $R_{11}$ and $R_{12}$ is independently a substituted or unsubstituted aliphatic group; $R_{13}$ is a substituent and n is an integer of 0 to 4, provided that when n is 2 or more, a plurality of $R_{13}$s are the same or different; $R_{14}$ is an alkyl group; and each $R_{15}$ and $R_{16}$ is independently an alkyl group having 3 to 8 carbon atoms, Formula (II):

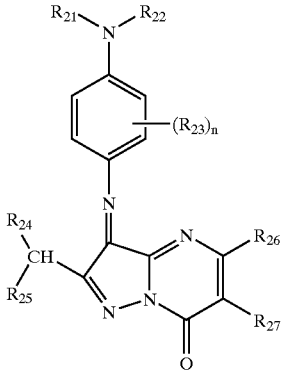

wherein each $R_{21}$ and $R_{22}$ is independently a substituted or unsubstituted aliphatic group; $R_{23}$ is a substituent and n is an integer of 0 to 4, provided that when n is 2 or more, a plurality of $R_{23}$s are the same or different; $R_{24}$ and $R_{25}$ each are an alkyl group; $R_{26}$ is a branched chain alkyl group; and $R_{27}$ is an alkyl group other than methyl group. Another objects of the present invention are achieved employing the embodiments described below.

I. A toner for an electrophotographic recording, which comprises a metal complex dye prepared from a compound containing a metal ion and a coloring material represented by Formula (I) or Formula (II).
II. A color filter comprising a metal complex dye prepared from a coloring material represented by Formula (I) or Formula (II) and a compound containing a metal ion.

DETAILED DESCRIPTION OF THE INVENTION

Figure 1:
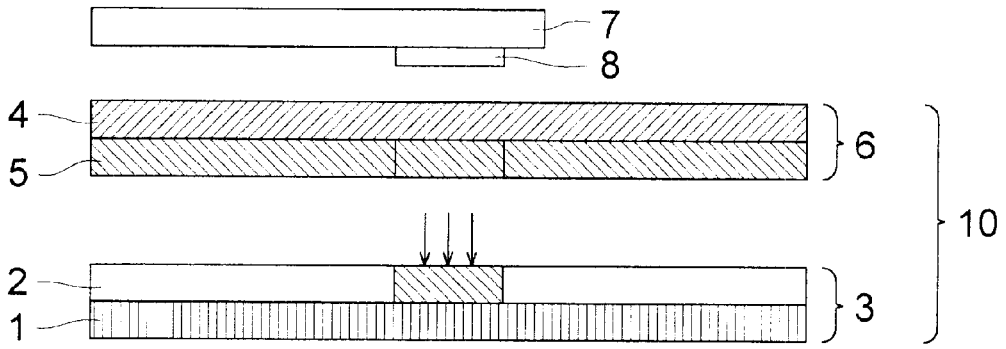
FIG. 1 is a schematic view showing one example of the thermal transfer recording method of the present invention.

In Formula (I), $R_{11}$ and $R_{12}$ represent a substituted or unsubstituted aliphatic group, and $R_{11}$ and $R_{12}$ may be the same or different. Listed as examples of said aliphatic groups are an alkyl group, a cycloalkyl group, an alkenyl group, and an alkynyl group. Listed as examples of said alkyl group may be a methyl group, an ethyl group, a propyl group, and an 1-propyl group. Listed as groups capable of substituting said alkyl groups may be a straight or branched chain alkyl group (for example, a methyl group, an ethyl group, an 1-propyl group, a t-butyl group, an n-dodecyl group, and a 1-hexylnonyl group); a cycloalkyl group (for example, a cyclopropyl group, a cyclohexyl group, a bicyclo [2.2.1]heptyl group, and an adamantyl group); an alkenyl group (for example, 2-propylene group and an oleyl group); an aryl group (for example, a phenyl group, an ortho-tolyl group, an ortho-anisyl group, a 1-naphthyl group, and a 9-anthranyl group); a heterocyclic group (for example, a 2-tetrahydrofuryl group, a 2-thiophenyl group, a 4-imidazoryl group, and a 2-pyridyl group); a halogen atom (for example, a fluorine atom, a chlorine atom, and a bromine atom); a cyano group; a nitro group; a hydroxy group; a carbonyl group (for example, an alkyl carbonyl group such as an acetyl group, a trifluoroacetyl group, and a pivaloyl group, and an aryl carbonyl group such as a benzoyl group, a pentafluorobenzoyl group, a 3,5-di-t-butyl-4-hydroxybenzoyl group); an oxycarbonyl group (for example, an alkoxycarbonyl group such as a methoxycarbonyl group, a cyclohexyloxycarbonyl group, and an n-dodecyloxycarbonyl group, and an aryloxycarbonyl group such as a phenoxycarbonyl group, a 2,4-di-t-amylphenoxycarbonyl group, a 1-napthyloxycarbonyl group, and a heterocyclic oxycarbonyl group such as a 2-pyridyloxycarbonyl group, a 1-phenylpyrazoryl-5-oxycarbonyl group); a carbamoyl group (for example, an alkylcarbamoyl group such as a dimethylcarbamoyl group and a 4-(2,4-di-t-amylphenoxy)butylaminocarbonyl group, and an arylcarbamoyl group such as a phenylcarbamoyl group and a naphthylcarbamoyl group); an alkoxy group (for example, a methoxy group, and a 2-ethoxyethoxy group); an aryloxy group (for example, a phenoxy group, a 2,4-di-t-amylphenoxy group, and a 4-(4-hydroxyphenylsufonyl) phenoxy group); a heterocyclic oxy group (for example, a 4-pyridyloxy group, and a 2-hexahydropyranyloxy group); a carbonyloxy group (for example, an alkylcarbonyloxy group such as an acetyloxy group, a trifluoroacetyloxy group, and a pivaloyloxy group, and an aryloxy group such as a benzoyloxy group and a pentafluorobenzoyloxy group); a urethane group (for example, an alkylurethane group such as an N,N-dimethylurethane group, and an arylurethane group such as an N-phenylurethane group and an N-(p-cyanophenyl)urethane group); a sulfonyloxy group (for example, an alkylsulfonyloxy group such as a methanesulfonyloxy group, a trifluoromethanesulfonyloxy group, and an n-dodecanesulfonyloxy group, and an arylsulfonyloxy group such as a benzenesulfonyloxy group and a p-toluenesulfonyloxy group); an amino group (for example, an alkylamino group such as a dimethylamino group, a cyclohexylamino group, an n-dodecylamino group, and an arylamino group such as an anilino group, a p-t-octylanilino group); a sulfonylamino group (for example, an alkylsulfonylamino group such as a methanesulfonylamino group, a heptafluoropropanesulfonylamino group, an n-hexadecylsulfonylamino group, and an arylsulfonylamino group such as a p-toluenesulfonylamino group and a pentafluorobenzenesulfonylamide); a sulfamoylamino group (for example, an alkylsulfamoylamino group such as an N,N-dimethylsulfamoylamino group and an arylsulfamoylamino group such as N-phenylsulfamoylamino group); an acylamino group (for example, an alkylcarbonylamino group such as an acetyl amino group and a myristoylamino group, and an arylcarbonylamino group such as a benzoyl amino group); a ureido group (for example, an alkylureido group such as an N-dimethylaminoureido group and an arylureido group such as an N-phenylureido group and an N-(p-cyanophenyl)ureido group); a sulfonyl group (for example, an alkylsulfonyl group such as a methanesulfonyl group and a trifluoromethanesulfonyl group, and an arylsulfonyl group such as a p-toluenesulfonyl group); a sulfamoyl group (for example, an alkylsulfamoyl group such as a dimethylsulfamoyl group and a 4-(2,4-di-t-amylphenoxy) butylaminosulfonyl group and an arylsulfamoyl group such as a phenylsulfamoyl group); an alkylthio group (for example, a methylthio group and a t-octylthio group); an arylthio group (for example, a phenylthio group); and a heterocyclic thio group (for example, a 1-phenyltetrazole-5-thio group and a 5-methyl-1,3,4-oxadiazole-2-thio group).

Listed as examples of said cycloalkyl group and said alkenyl group are those which are the same as said substituents. Further, listed as examples of said alknyl group are 1-propyne, 2-butyne, and 1-hexyne.

It is preferable that $R_{11}$ and $R_{12}$ bond with each other to form a non-aromatic cyclic structure (for example, a pyrrolidine ring, a piperidine ring, and a morpholine ring).

Listed as $R_{13}$ are those which are the same group as above, capable of substituting said alkyl group. Of said substituents, preferred are an alkyl group, a cycloalkyl group, an alkoxy group and an acylamino group. "n" represents 0 or an integer of 1 to 4. When n is 2 or more, a plurality of $R_{13}$ may be the same or different.

$R_{14}$ represents an alkyl group. Listed as examples of $R_{14}$ are a methyl group, an ethyl group, an 1-propyl group, a t-butyl group, an n-dodecyl group, and a 1-hexylnonyl group. $R_{14}$ is preferably a secondary or tertiary alkyl group. Examples of preferred secondary or tertiary alkyl groups include an isopropyl group, a sec-butyl group, a tert-butyl group, and a 3-heptyl group. The most preferred substituents of $R_{14}$ are an isopropyl group, and a tert-butyl group. The alkyl group of $R_{14}$ may be substituted, but is most preferably one which is substituted with a substituent only comprised of carbon atoms and hydrogen atoms.

$R_{15}$ represents an alkyl group having from 3 to 8 carbon atoms. Listed as examples of $R_{15}$ are an n-propyl group, an 1-propyl group, a t-butyl group, an n-dodecyl group, and a 1-hexylnonyl group. $R_{15}$ is preferably a secondary or tertiary alkyl group. Listed as examples are an isopropyl group, a sec-butyl group, a tert-butyl group, and a 3-heptyl group. The most preferred substituents of $R_{15}$ include an isopropyl group and a tert-butyl group. Alkyl group $R_{15}$ may be substituted, but is most preferably one which is substituted with a substituent only comprised of carbon atoms and hydrogen atoms.

$R_{16}$ represents an alkyl group having from 3 to 8 carbon atoms. Listed as examples of $R_{16}$ are an n-propyl group, an n-butyl group, an n-pentyl group, an n-hexyl group, an n-heptyl group, an isopropyl group, a sec-butyl group, a tert-butyl group, and a 3-heptyl group. Specifically preferred substituents as $R_{16}$ are straight chain alkyl groups having at least 3 carbon atoms. The examples include an n-propyl group, an n-butyl group, an n-pentyl group, an n-hexyl group, and an n-heptyl group. Of these, an n-propyl group and an n-butyl group are most preferred. Incidentally, the alkyl group of $R_{16}$ may be substituted, but is most preferably one which is substituted with a substituent only comprised of carbon atoms and hydrogen atoms.

In Formula (II), $R_{21}$ and $R_{22}$ represent a substituted or unsubstituted aliphatic group. $R_{21}$ and $R_{22}$ may be the same or different. Examples of said aliphatic groups are the same as those of $R_{11}$ and $R_{12}$ of aforesaid Formula (I).

$R_{23}$ is the same as $R_{13}$ in aforesaid Formula (I). $R_{24}$ and $R_{25}$ represent an alkyl group. Listed as examples are a methyl group, an ethyl group, an n-propyl group, an n-butyl group, an n-pentyl group, an n-hexyl group, an n-heptyl group, an isopropyl group, a sec-butyl group, a tert-butyl group, and a 3-heptyl group. In $R_{24}$ and $R_{25}$, specifically preferred substituents are straight chain alkyl groups.

$R_{26}$ represents a branched chain alkyl group (including secondary and tertiary alkyl groups). Listed as secondary or tertiary alkyl groups are an isopropyl group, a sec-butyl group, a tert-butyl group, and a 3-heptyl group. The most preferred substituents as $R_{26}$ are an isopropyl group and a tert-butyl group. The branched chain alkyl groups of $R_{26}$ may be substituted, but are most preferably ones which are substituted with a substituent only comprised of carbon atoms and hydrogen atoms.

The number of the total carbon atoms of branched chain alkyl group is preferably from 3 to 20, is more preferably from 3 to 15, and is most preferably from 3 to 8.

$R_{27}$ represents an alkyl group. Listed as examples of $R_{27}$ are an ethyl group, an n-propyl group, an n-butyl group, an n-pentyl group, an n-hexyl group, an isopropyl group, a sec-butyl group, a tert-butyl group, and a 3-heptyl group. Specifically preferred substituents as $R_{27}$ are straight chain alkyl groups having at least 2 carbon atoms. Examples include an ethyl group, an n-propyl group, an n-butyl group, an n-pentyl group, an n-hexyl group, and an n-heptyl group. Of these, an n-propyl group and an n-butyl group are most preferred. Incidentally, the alkyl group of $R_{27}$ may be substituted, but is most preferably one which is substituted with a substituent only comprised of carbon atoms and hydrogen atoms.

In order to employ dyes represented by Formulas (I) and (II) in the image forming method utilizing the so-called thermal transfer system in which images are formed by said dyes thermally transferred, it is required that said dyes exhibit good transferability. Generally, it is assumed that as their molecular weight decreases, their transferability increases. However, when their molecular weight is excessively small, problems with the formation of bleeding during storage occasionally occur. The inventors of the present invention conducted diligently investigations to overcome said drawbacks. As a result, it was discovered that dyes having a molecular weight in the specified range minimized bleeding during storage. Namely, it was discovered that the molecular weight of said dyes was preferably from 400 to 600, and was more preferably from 400 to 500.

Specific examples of dyes represented by Formulas (I) and (II) will now be listed. However, the present invention is not limited to these examples.

1
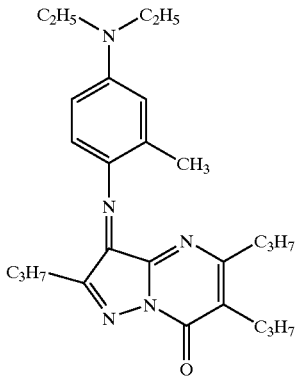
2
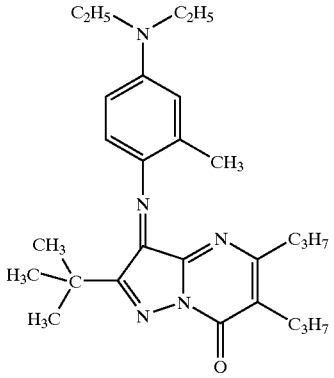
3
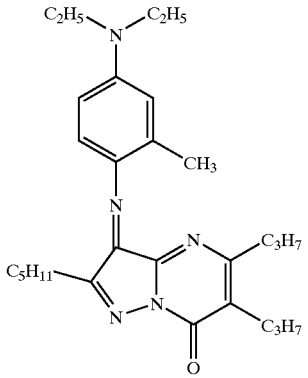
4
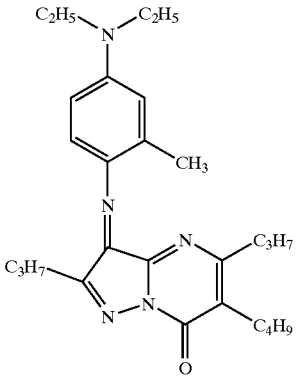
-continued
5
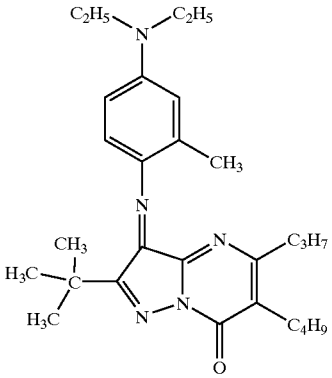
6
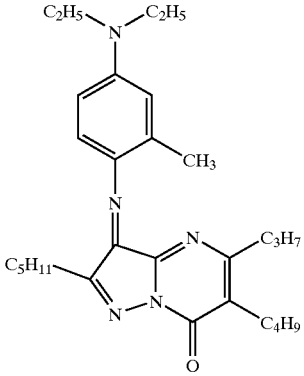
7
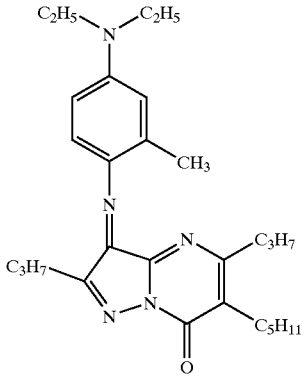
8
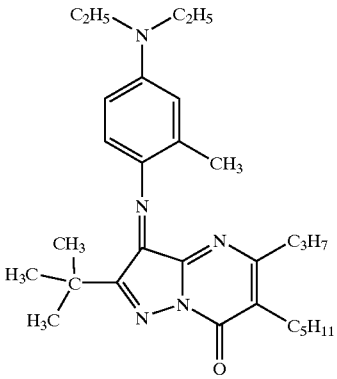

-continued
9
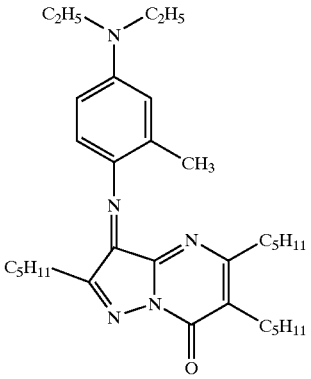
10
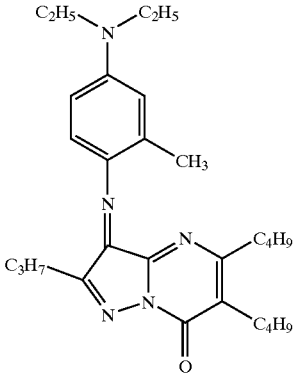
11
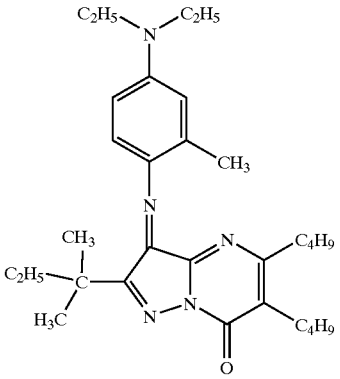
12
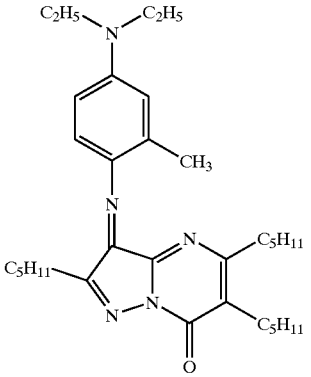
-continued
13
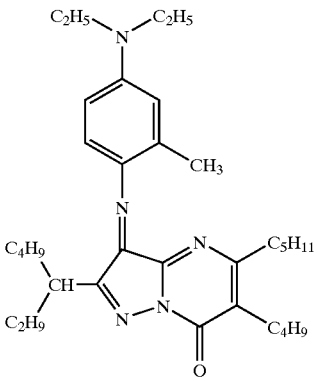
14
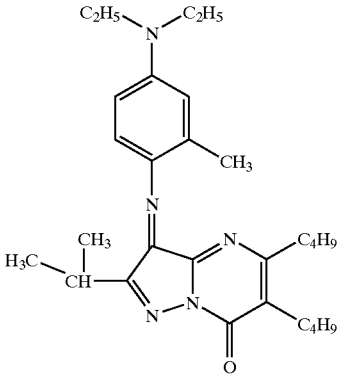
15
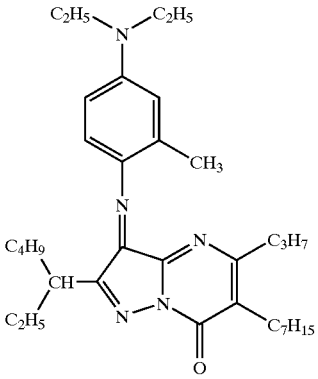
16
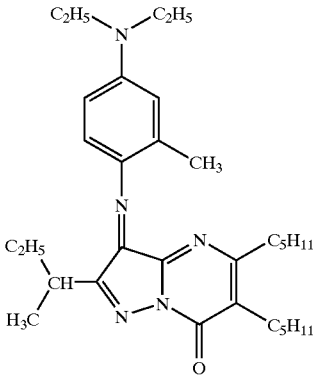

-continued
17
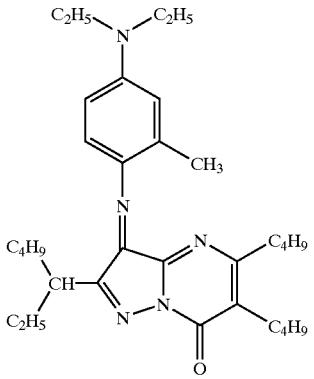
18
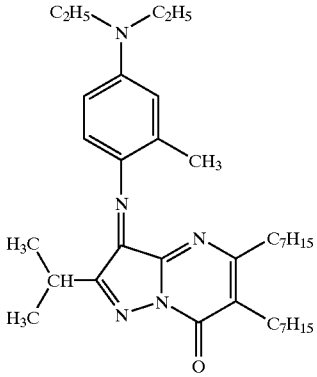
19
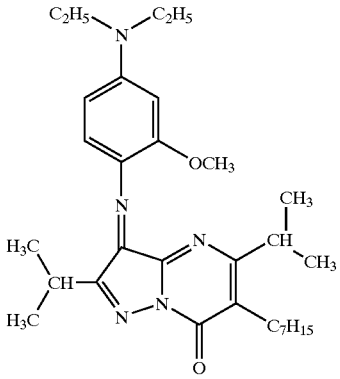
20
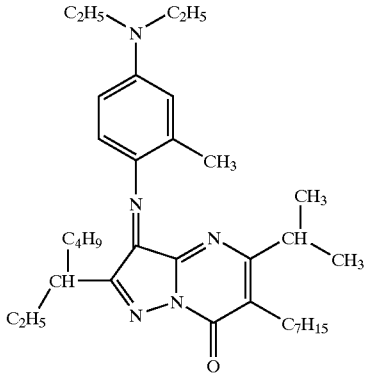
-continued
21
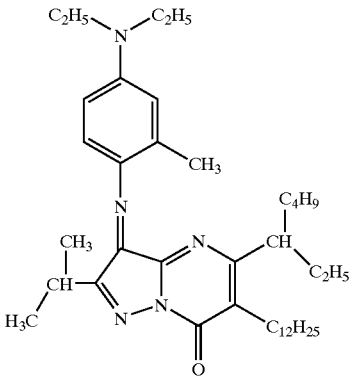
22
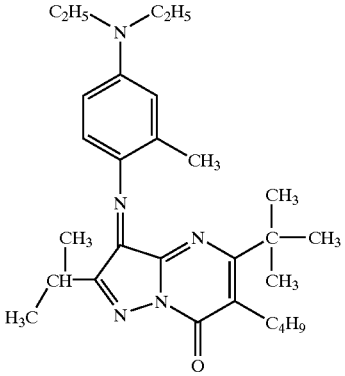
23
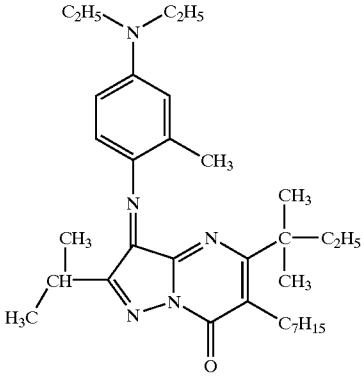
24
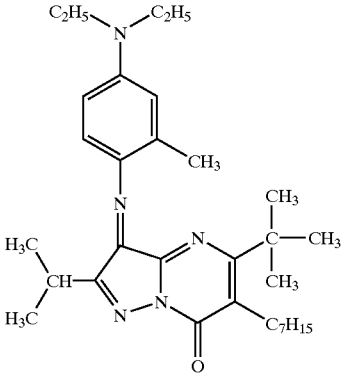

-continued
25
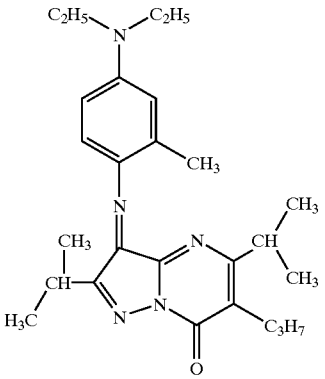
26
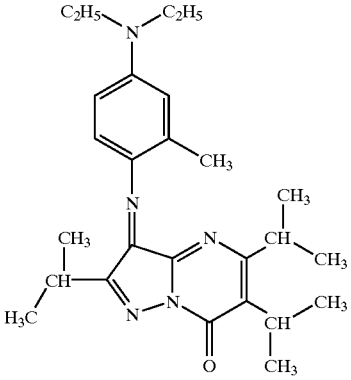
27
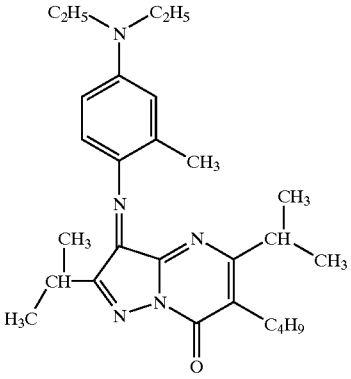
28
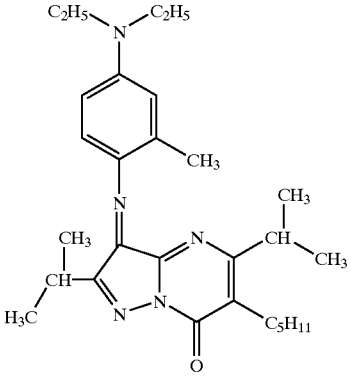
-continued
29
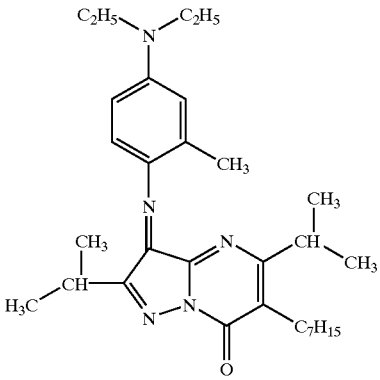
30
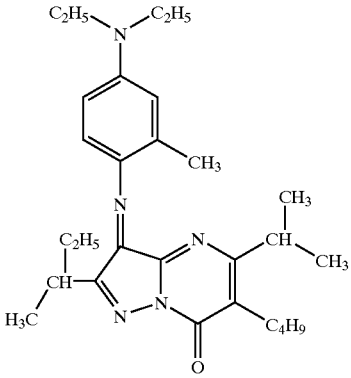
31
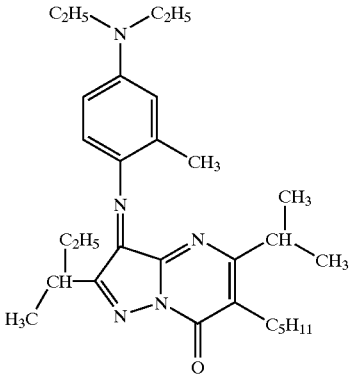
32
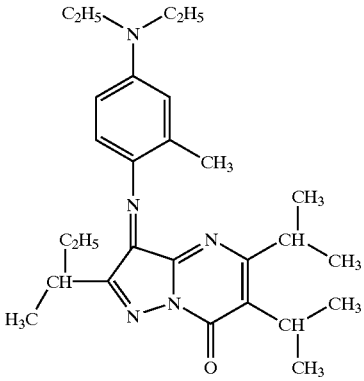

-continued

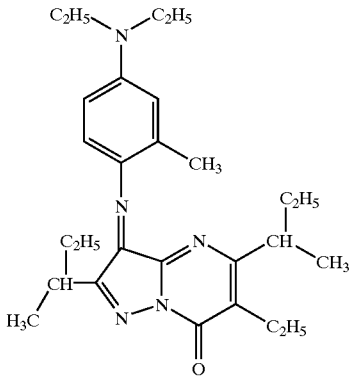

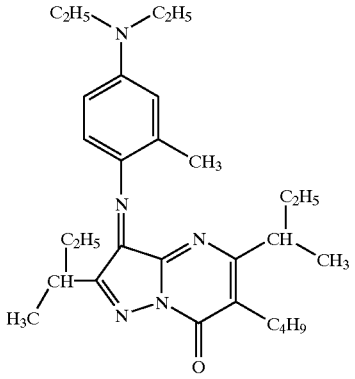

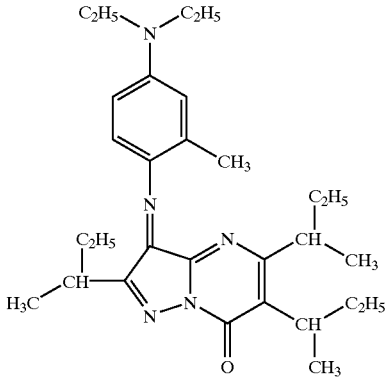

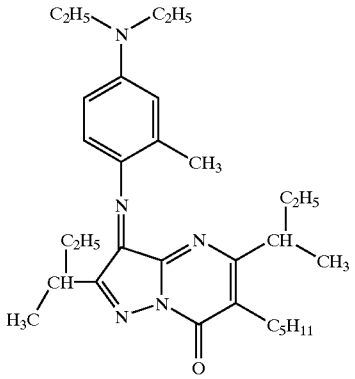

It is possible to synthesize the compounds of the present invention, for example, Exemplified Compound 27, utilizing the scheme described below.

Exemplified Compound 27

Synthesis Scheme

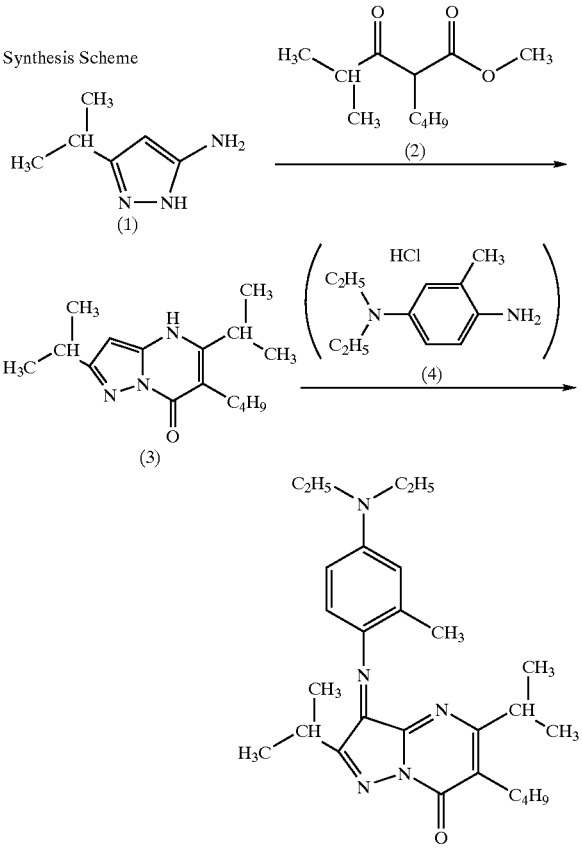

(Synthesis of Exemplified Compound 27)

In 150 ml of xylene were dissolved 38 g of aminopyrazole (1) and 50.7 g of keto ester (2), and the resultant mixture was heated for 7 hours while distilling off the solvent. The addition of ethyl acetate to the resultant oily product was subjected to crystal deposition, which was subsequently collected through filtration, whereby 35 g of dye precursor (3) were obtained.

To 4.62 g of dye precursor (3) were added 75 ml of ethyl acetate, and further, a solution prepared by dissolving 6.96 g of potassium carbonate in 10 ml of water was added. While vigorously stirring in a water bath at 45° C., a small amount of a solution prepared by dissolving 6.48 g of aniline analog (4) in 15 ml of water, and a solution prepared by dissolving 14.4 g of sodium persulfate and 12.8 g of sodium carbonate in 50 ml water were alternately added to the reaction mixture. After completion of the addition, the resultant mixture was vigorously stirred at 45° C. for an additional hour, followed by cooling the reaction mixture. Crystal deposits were collected through filtration, whereby 5.6 g of green crystals exhibiting a metallic luster were obtained (at a yield of 74 percent). The structure was identified employing NMR spectra and mass spectra. Further, it was found that Xmax of Exemplified Compound 27 was 605 nm in an acetone solution.

Further, it is possible to synthesize other exemplified compounds employing the same method described above.

The thermal transfer recording material of the present invention comprises a support having thereon a dye providing layer comprising dyes of the present invention. It is possible to form said dye providing layer as follows: a dye providing layer coating composition, which is prepared by dissolving dyes together with binders in solvents, or by dispersing those into solvents in the form of fine particles, is applied onto a support and subsequently is suitably dried. The thickness of said dye providing layer is preferably from 0.1 to 10 $\mu$m in terms of its dried layer thickness.

Preferably employed as said binders are solvent-soluble polymers such as acrylic resins, methacrylic resins, polystyrene, polycarbonate, polysulfone, polyethersulfone, polyvinyl butyral, polyvinyl acetal, nitrocellulose, and ethyl cellulose. At least one type of these binders is dissolved in organic solvents and employed. In addition, they may be dispersed so as to form a latex and then employed. The used amount of said binders is preferably from 0.1 to 20 g per $m^2$ of the support.

Said solvents include alcohols (such as ethanol and propanol), cellosolves (such as methyl cellosolve and ethyl cellosolve), aromatic compounds (such as toluene and xylene), esters (such as ethyl acetate), ketones (such as acetone and methyl ethyl ketone), and ethers (such as tetrahydrofuran and dioxane).

Employed as said supports are those which exhibit good dimensional stability and good resistance to heating by a thermal head during recording. Preferably employed are thin paper such as condenser paper and glassine paper, and heat resistant plastic films comprised of polyethylene terephthalate, polyamide, and polycarbonate. The thickness of said support is preferably from 2 to 30 $\mu$m.

Further, with the purpose of enhancing adhesion properties with binders and of minimizing transfer and dying of dyes to said support, said support preferably comprises a sublayer comprised of selected polymers. Still further, in order to minimize adhesion of a head to said support, a slipping layer may be provided on the back surface (the surface opposite the thermal transfer layer) of said support.

With the purpose of employing image receiving materials such as plain paper, described below, in which an image receiving layer is not specifically provided, the thermal transfer recording material of the present invention may comprise on said dye providing layer or as another layer a heat fusible layer comprising heat fusible compounds described in Japanese Patent Publication Open to Public Inspection No. 59-106997. Said heat fusible compounds are preferably colorless or white compounds which melt at a temperature of 65 to 150° C., and include, for example, waxes such as carnauba wax, bees wax, and candelilla wax.

Incidentally, said heat fusible layer may comprise, for example, polymers such as polyvinyl pyrrolidone, polyvinyl butyral, polyester, and vinyl acetate.

In order to apply the thermal transfer material of the present invention to full-color image recording, it is preferable that the total three layers comprised of a yellow thermal transfer layer comprising heat diffusible yellow dyes capable of forming a yellow image, a magenta thermal transfer layer comprising heat diffusible magenta dyes capable of forming a magenta image, and a cyan thermal transfer layer comprising heat diffusible cyan dyes capable of forming a cyan image, are successively applied onto the same surface of a support. If desired, a total of four layers comprising the additional thermal transfer layer comprising black image forming materials may be successively applied onto the same surface.

In the thermal transfer recording method of the present invention, an image receiving material faces a dye providing material comprising a dye providing layer comprising at least one type of dyes represented by aforesaid Formulas (I) or (II), and images are formed by heating said dye providing material based on image information and by transferring said dyes.

Further, it is preferable to employ combinations of the dyes of the present invention with metal ion containing compounds. Namely, an image receiving material comprised of a dye receiving layer comprising metal ion containing compounds on a support faces a dye providing material comprised of a dye providing layer comprising at least one type of dye represented by aforesaid Formulas (I) and (II), and said thermal transfer recording material is heated based on image information, whereby metal chelate dye images are formed upon reaction of said dyes with said metal ion containing compounds. Said metal ion containing compounds may be incorporated into said image receiving material or into said heat fusible layer of said thermal transfer recording material.

Listed as metal ion containing compounds are inorganic or organic salts of metal ions and metal chelates. Of these, salts and chelates of organic acids are preferred.

Listed as said metals are univalent and polyvalent metals which belong to Groups V through VIII of the Periodic Table. Of these, preferred are Al, Co, Cr, Cu, Fe, Mg, Mn, Mo, Ni, Sn, Ti and Zn, of which Ni, Cu, Cr, Co, and Zn are specifically preferred.

Listed as specific example of metal ion containing compounds are salts of aliphatic acids such as acetic acid and stearic acid and salts of aromatic carboxylic acids such as benzoic acid and salicylic acid with $Ni^{2+}$, $Cu^{2+}$, $Cr^{2+}$, $Co^{2+}$, and $Zn^{2+}$. Further, it is most preferably to employ complexes represented by the Formula (III) described below:

(1) Formula (III)

$$[M(Q_1)_a(Q_2)_b(Q_3)_c](Y^-)_p$$

wherein M represents a metal ion, preferred ones including $Ni^{2+}$, $Cu^{2+}$, $Cr^{2+}$, $Co^{2+}$, and $Zn^{2+}$; $Q_1$, $Q_2$, and $Q_3$ each represent a ligand capable of forming a coordination bond with the metal ion represented by M and may be the same or different. It is possible to select ligands from those described in, for example, "Chelate Kagaku (Chelate Science) (5)", published by Nankodo, Tokyo, Japan.

Y represents an organic anionic group. Specifically listed as Y are a tetraphenyl borate anion and an alkylbenzene sulfonate anion.

"a" represents 1, 2, or 3; "b" represents 0, or 1 or 2; and "c" represents 0 or 1. However, these are determined depending on the tetradentate ligand or hexadentate ligand of the complex represented by Formula (III) or on the number of ligands of $Q_1$, $Q_2$, and $Q_3$. "p" represents 0, 1, or 2. p=0 means that the ligand represented by Q is an anionic compound, and the anionic compound represented by Q and the metal cation represented by M are in an electrically neutralized state by combining together.

Preferred as anionic compounds are those represented by Formula (IV) described below.

Formula (IV)

$$O^-—C(R^5)=C(R^7)—C(=O)(R_6)$$

wherein $R^5$ and $R^6$ each represent an alkyl group or an aryl group, and may be the same or different; and $R^7$ represents an alkyl group, an alkoxy group, an alkoxycarbonyl group, a halogen atom, or a hydrogen atom.

The added amount of metal ion containing compounds is preferably from 0.5 to 20 g/$m^2$ with respect to the image receiving material or the heat fusible layer, and is more preferably from 1 to 15 g/$m^2$.

The image receiving material, which forms images utilizing metal chelate dyes, comprises a support, such as paper, plastic film, or paper-plastic film composites, having thereon a polymer layer comprised of at least one type of a polyester resin, a polyvinyl chloride resin, a copolymer of vinyl chloride with other monomers (such as vinyl acetate), polyvinyl butyral, polyvinylpyrrolidone, and polycarbonate as the image receiving layer.

If desired, said image receiving material may comprise antioxidants and releasing agents in the image receiving layer, and may also be provided with a protective layer on the image receiving layer. Further, with the purpose of enhancing adhesion, heat insulation, and a cushion effect, an interlayer may be provided between the support and the image receiving layer. Further, on the rear surface (the surface opposite the image receiving layer), provided may be an antistatic layer and a backing layer comprising fine inorganic or organic non-sublimable particles for the purpose of minimizing blocking. Still further, the image receiving layer may be provided on both sides of the support. Incidentally, the support itself may occasionally be employed as the image receiving material.

In thermal transfer recording methods, heat is commonly provided employing a thermal head. However, heat may be provided by an electrical current or by employing a laser. Heat application employing a thermal head may be carried out without any particular limitation on the rear surface of the image receiving layer. However, when the transfer rate of the dyes and image density are taken into account, it is preferable that heat be provided onto the rear surface of the dye providing material. Further, prior to the dye transfer, during the dye transfer, or after the dye transfer, heat may be provided so that the dye transfer, the reaction with the metal ion containing compounds, and the fixing of transfer dyes are enhanced.

One example of the thermal transfer recording method of the present invention will be described with reference to FIGS. 1 and 2.

A thermal transfer recording material, shown in FIG. 1, is constituted in such a manner that image receiving material 3 comprises support 1 having thereon image receiving layer 2 comprising metal ion containing compounds, while dye providing material 6 comprises support 4 having thereon dye providing layer 5. In image receiving material 3 and dye providing material 6, an interlayer may be provided between each layer and support 1.

The thermal transfer recording method is such that image receiving material 3 faces dye providing material 6, and heat is applied onto the rear surface of dye providing material 6, employing heat generating resistor 8 based on image information, and subsequently, both materials are separated. During heat application, dyes in dye providing layer 5 are allowed to react with the metal ion containing compounds in image receiving layer 2, whereby metal chelate dye images are formed.

Figure 2:
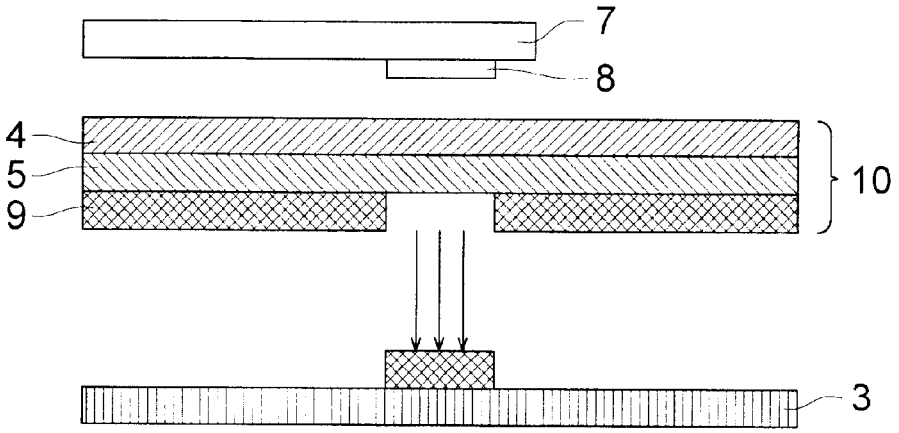
FIG. 2 is a schematic view showing another example of the thermal transfer recording method of the present invention.

Further, in the thermal transfer recording material in FIG. 2, thermal transfer recording material 10, which is prepared by laminating heat fusible layer 9, comprising metal ion containing compounds on dye providing material 6 (4 and 5) faces image receiving material 3 such as plain paper, previously described, in which an image receiving layer is not specifically provided, and thermal head 7 is applied employing the same method as the thermal transfer recording method of FIG. 1. Thereafter, both materials are peeled off so that an image is formed. In this method, when heat is provided employing thermal head 7, a metal chelate dye image is formed upon allowing the dyes to react with metal ion containing compounds between dye providing layer 5 on thermal transfer recording material 10 and the heat fusible layer, and subsequently, the resulting image is transferred onto image receiving layer 3.

It is possible to employ ink comprising the compounds of the present invention in various ink jet recording liquid such as a water based ink jet recording liquid, an oil based ink jet recording liquid, and a solid (phase change) ink jet recording liquid.

In said water based ink jet recording liquid, in addition to the compounds of the present invention, water and water-soluble organic solvents are commonly employed as the solvent. Listed as water-soluble organic solvents are alcohols (for example, methanol, ethanol, propanol, isopropanol, butanol, isobutanol, secondary butanol, tertiary butanol, pentanol, hexanol, cyclohexanol, and benzyl alcohol); polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, and thioglycol); polyhydric alcohol ethers (for example, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, ethylene glycol monophenyl ether, and propylene glycol monophenyl ether); amines (for example, ethanolamine, diethanolamine, triethanolamine, N-methyldiethanolamine, N-ethyldiethanolamine, morpholine, N-ethylmorpholine, ethylenediamine, diethylenediamine, triethylenetetraamine, tetraethylenepentamine, polyethyleneimine, pentamethyldiethylenetriamine, and tetramethylpropylenediamine); amides (for example, formamide, N,N-dimethylformamide, and N,N-dimethylacetamide); heterocycles (for example, 2-pyrrolidone, N-methyl-2-pyrrolidone, cyclohexylpyrrolidone, 2-oxazolidone, and 1,3-dimethyl-2-imidazolidinone); sulfoxides (for example, dimethylsulfoxide); sulfones (for example, sulfolane); urea; acetonitrile; and acetone.

In said water based ink jet recording liquid, when dyes are soluble in the solvent system, said dyes may be dissolved in said solvent without any modification and then employed. On the other hand, when dyes are insoluble solids, it is possible to disperse the compounds of the present invention into minute particles employing various homogenizers (for example, a ball mill, a sand mill, an attritor, a roll mill, an agitator mill, a Henschel mixer, a colloid mill, an ultrasonic homogenizer, a pearl mill, a jet mill, and an angmill), or after dissolving said dyes in organic solvents, it is possible to disperse the resulting solution into said solvent system together with polymer dispersing agents and surface active agents. Further, when dyes are an insoluble liquid or a semi-melt type, it is possible to disperse said dyes, without any treatment or dyes which are dissolved in organic solvent, into the solvent system together with polymer dispersing agents and surface active agents. Regarding specific methods for preparing said water based ink jet recording liquid, it is possible to employ methods described in, for example, Japanese Patent Publication Open to Public Inspection Nos. 5-148436, 5-295312, 7-97541, 7-82515, and 7-118585.

In said oil based ink jet recording liquid, in addition to the dyes of the present invention, organic solvents may also be employed as the solvent.

Listed as examples of solvents of said oil based ink jet recording liquid are alcohols (for example, pentanol, heptanol, octanol, phenylethyl alcohol, phenylpropyl alcohol, furfuryl alcohol, and anil alcohol); esters (for example, ethylene glycol diacetate, ethylene glycol monomethyl ether acetate, diethylene glycol monomethyl ether acetate, propylene glycol diacetate, ethyl acetate, amyl acetate, benzyl acetate, phenyl ethyl acetate, phenoxyethyl acetate, ethyl phenylacetate, benzyl propionate, ethyl benzoate, butyl benzoate, butyl laurate, isopropyl myristate, triethyl phosphate, tributyl phosphate, diethyl phthalate, dibutyl phthalate, diethyl malonate, dipropyl malonate, diethyl diethylmalonate, diethyl succinate, dibutyl succinate, diethyl glutarate, diethyl adipate, dipropyl adipate, dibutyl adipate, di(2-methoxyethyl) adipate, diethyl sebacate, diethyl maleate, dibutyl maleate, and dioctyl maleate, diethyl fumarate, dioctyl fumarate, and 3-hexenyl cinnamate); ethers (for example, butyl phenyl ether, benzyl ethyl ether, and hexyl ether); ketones (for example, benzyl methyl ketone, benzylacetone, acetone alcohol, and cyclohexanone); hydrocarbons (for example, petroleum ether, petroleum benzyl, tetralin, decalin, tertiary amylbenzene, and dimethylnaphthalene); and amides (for example, N,N-diethyldodecane amide).

In said oil based ink jet recording liquid, said dyes may be dissolved in said solvents without any treatment and subsequently employed. Further, said dyes may be dispersed into, or dissolved in, solvents while employing resinous dispersing agents and binding agents. In addition, a greater volume of water-soluble organic solvents, those previously described, may be employed.

Regarding specific methods for preparing said oil based ink jet recording liquid, it is possible to refer to methods described in, for example, Japanese Patent Publication Open to Public Inspection No. 3-231975 and Japanese Patent Publication Open to Public Inspection (under PCT Application) Tokuhyouhei No. 5-508883.

In said solid (phase change) ink jet recording liquid, in addition to the compounds of the present invention, employed as solvents are phase change solvents which are solid at room temperature and melt liquid during ink ejection.

Listed as said phase change solvents are natural waxes (for example, bees wax, carnauba wax, rice wax, Japan wax, jojoba, spermaceti, candelilla wax, lanolin, montan wax, ozokerite, ceresin, paraffin wax, microcrystalline wax, and petrolatum); polyethylene wax derivatives; chlorinated hydrocarbons; organic acids (for example, palmitic acid, stearic acid, behenic acid, tiglic acid, 2-acetonaphthonbehenic acid, 12-hydroxystearic acid, and dihydroxystearic acid); organic acid esters (for example, esters of said organic acids with alcohols such as glycerin, diethylene glycol, and ethylene glycol); alcohols (for example, dodecanol, tetradecanol, hexadecanol, eicosanol, docosanol, tetracosanol, hexacosanol, octacosanol, dodecenol, myrysil alcohol, tetracenol, hexadecenol, eicocenol, pinene glycol, hinokitiol, butynediol, nonanediol, isophthalyl alcohol, meciserin, teraphthalyl alcohol, hexanediol, decanediol, dodecanediol, tetradecanediol, hexadecanediol, docosanediol, tetracosanediol, terebineol, phenylglycerin, eicosanediol, octanediol, phenylpropylene glycol, bisphenol A, and para-alphacumylphenol); ketones (for example, benzoylacetone, diacetobenzene, benzophenone, tricosanone, heptacosanone, heptatriacontanone, hentriacontanone, heptatriacontanone, stearone, laurone, and dianisole); amides (for example, oleic acid amide, lauric acid amide, stearic acid amide, ricinoleic acid amide, palmitic acid amide, tetrahydrofuroic acid amide, erucic acid amide, myristic acid amide, 12-hydroxystearic acid amide, N-stearylerucic acid amide, N-oleylstearic acid amide, N,N'-ethylenebislauric acid amide, N,N'-ethylenebisstearic acid amide, N,N'-ethylenebisoleic acid amide, N,N'-methylenebisstearic acid amide, N,N'-ethylenebisbehenic acid amide, N,N'-xylylenebisstearic acid amide, N,N'-butylenebisstearic acid amide, N,N'-dioleyladipic acid amide, N,N'-distearyladipic acid amide, N,N'-dioleylsebacic acid amide, N,N'-cystearylsebcic acid amide, N,N'-distearylterephthalic acid amide, N,N'-distearylisophthalic acid amide, phenacetin, toluamide, and acetamide; reaction product tetraamides of dimer acid, diamine, and fatty acid such as oleic acid dimer/ethylenediamine/stearic acid (at a mole ratio of 1:2:2); sulfone amides (for example, para-toluenesufone amide, ethylbenzenesulfone amide, and butylbenzenesulfone amide), silicones (for example, Silicone SH6018, manufactured by Toray Silicone), and Silicone $KR_{215,\ 216}$, and 220, manufactured by Shin-Etsu Silicone); cumarones (for example, Eskuron G and 90, manufactured by Shin-Nittetsu Kagaku); cholesterol fatty acid esters (for example, stearic acid cholesterol, palmitic acid cholesterol, myristic acid cholesterol, behenic acid cholesterol, lauric acid cholesterol, and melissic acid cholesterol); and saccharides fatty acid esters (for example, stearic acid sucrose, palmitic acid sucrose, behenic acid sucrose, lauric acid sucrose, melissic acid sucrose, stearic acid lactose, palmitic acid lactose, myristic acid lactose, behenic acid lactose, lauric acid lactose, and melissic acid lactose).

The phase change temperature for the solid-liquid phase change of solid ink is preferably at least 60° C., and is more preferably from 80 to 150° C.

When said solid ink jet recording liquid is employed, it is possible to use the dye of the present invention without any modification after dissolving it in a solvent heated to a melted state. It is also possible to use said dye after it is subjected to dispersion, together with resinous dispersing agents and binding agents or to dissolution.

Regarding specific methods for preparing said solid ink jet recording liquid, it is possible to refer to methods described in Japanese Patent Publication Open to Public Inspection Nos. 5-186723 and 7-70490.

The viscosity of said water based, oil based, or solid ink jet recording liquid is preferably no more than 40 cps during ejection, and is more preferably no more than 30 cps.

The surface tension of the ink jet recording liquid of the present invention is preferably at least 20 dyn/cm during ejection, and is more preferably from 30 to 80 dyn/cm.

The content ratio of the dye for the present invention is preferably in the range of 0.1 to 25 percent by weight with respect to the weight of the total ink jet recording liquid, and is more preferably in the range of 0.5 to 10 percent by weight.

Depending on the purpose of enhancing the ejection stability, the adaptability to the print head and the ink cartridge, the storage stability, the image retaining quality, and other performance factors, viscosity modifiers, surface tension regulating agents, specific resistivity regulating agents, film forming agents, dispersing agents, surface active agents, UV absorbers, antioxidants, antifading agents, mildewcides, and antirusting agents may be incorporated into the ink jet recording liquid of the present invention.

Recording systems in which said ink jet recording liquid is used are not particularly limited, but said ink jet recording liquid may be preferably employed as an ink particularly for an on-demand type ink jet printer. Listed as specific examples of on-demand type systems may be an electromechanical conversion system (for example, a single cavity type, a double cavity type, a bender type, a piston type, a share mode type, and a shared wall type), an electrothermal conversion system (for example, a thermal ink jet type and a bubble ink jet type), an electrostatic suction system (for example, an electric field controlling type and a slit jet type), a discharge system (for example, a spark jet type).

When the compounds of the present invention are employed as toner dyes for electrophotography, it is possible to employ any of the binders which are commonly employed to prepare a toner. For example, listed are styrene based resins, acryl based resins, styrene/acryl based resins, and polyester resins.

With the purpose of enhancing fluidity and controlling charging, fine inorganic powder and fine organic particles may externally be incorporated into said toner. Fine silica and titania particles whose surface has been treated with alkyl group-containing coupling agents are preferably employed. Incidentally, the number average primary particle diameter of these is preferably from 10 to 500 nm, and further, their content ratio in said toner is preferably from 0.1 to 20 percent by weight.

Employed as releasing agents may be any of those which have conventionally been used. Specifically listed are olefin analogs such as low molecular weight polypropylene, low molecular weight polyethylene, and ethylene-propylene copolymers, waxes such as microcrystalline wax, carnauba wax, sazol wax, and paraffin. The added amount of these is preferably from 1 to 5 percent by weight with respect to the toner.

If desired, charge controlling agents may also be incorporated, but from the viewpoint of coloration, they are preferably colorless. Listed as examples are those having a quaternary ammonium salt structure, and a calixarene structure.

Either a non-coated carrier, which is comprised only of maganetic material particles such as iron and ferrite, or a coated carrier, in which the surface of magnetic material particles is coated with resins, may be employed. The average particle diameter of said carrier particles is preferably from 30 to 150 $\mu$m in terms of the volume average particle diameter.

Image forming methods, to which the toner of the present invention applies, are not particularly limited. Listed as said methods are, for example, one in which after repeatedly forming the desired color images on the photoreceptor, images are formed upon being transferred, and the other in which an image formed on the photoreceptor is successively transferred onto an intermediate transfer body, and after forming a color image on said intermediate transfer body, the final color image is formed upon being transferred onto an image forming member such as a paper sheet.

It is possible to prepare the color filter of the present invention, employing colored compositions comprising dyes (I) and (II) of the present invention. It is possible to prepare said colored compositions by dispersing the dyes of the present invention into transparent resins. It is possible to disperse said dyes employing various kinds of dispersion means such as a double-roller mill, a triple-roller mill, a sand mill, and a kneader.

Employed as resinous varnishes which are employed to prepare said colored compositions by dispersing the dyes of the present invention, are those, known in the art, which are employed in colored compositions for color filters. Further, employed as dispersion media are solvents or water based media which are suitable for resinous varnishes. Still further, if desired, employed may be additives conventionally known in the art such as dispersing aids, smoothing agents, and adhesion enhancing agents.

Employed as resinous varnishes may be photosensitive resinous varnishes and non-photosensitive resinous varnishes. Employed as said photosensitive varnishes include, for example, any of those which are employed in ultraviolet ray hardening ink, and electron beam hardening ink. On the other hand, employed as said non-photosensitive resinous varnishes may be, for example, any of those which are employed in printing inks such as letterpress ink, lithography ink, intaglio gravure ink, and screen printing ink, varnishes employed in developers for electronic printing and electrostatic printing, and varnishes for thermal transfer ribbon.

Listed as examples of photosensitive resinous varnishes are varnishes of photosensitive cyclic rubber based resins, photosensitive phenol based resins, photosensitive polymethacrylate based resins, photosensitive polyamide based resins, and photosensitive polyimide based resins, and varnishes of unsaturated polyester based resins, polyester acrylate based resins, polyepoxyacrylate based resins, polyurethane acrylate based resins, polyether acrylate based resins, and polyol acrylate based resins. The photosensitive colored composition of the present invention is prepared in such a manner that photopolymerization initiators such as benzoin ether and benzophenone are added to the compounds of the present invention and said varnishes, and the resultant mixture is kneaded. Further, it is possible to prepare a thermally polymerizable colored composition, employing thermal polymerization initiators instead of said photopolymerization initiators. When the pattern of color filters is formed employing said photosensitive colored composition, said photosensitive colored composition is subjected to spin-coating or total surface coating onto a transparent substrate, employing a low speed rotation coater, a roll coater, or a knife coater, or it is subjected to total surface printing or partial printing slightly larger than said pattern, employing various kinds of printing methods, and subsequently, the pattern is printed through exposure employing an ultra high pressure mercury arc lamps. Subsequently, development and washing are carried out, and then, if desired, post-baking is carried out, whereby it is possible to form a pattern in said color filter.

Listed as examples of non-photosensitive resinous varnishes are cellulose acetate based resins, nitrocellulose based resins, styrene based (co)polymers, polyvinyl butyral based resins, aminoalkyd based resins, polyester based resins, amino resin-modified polyester based resins, polyurethane based resins, acryl polyol urethane based resins, soluble polyamide resins, soluble polyimide based resins, soluble polyamidoimide based resins, soluble polyester imide based resins, casein, hydroxyethyl cellulose, water-soluble salts of styrene-maleic acid ester based copolymers, water-soluble salts of acrylic acid ester based (co)polymers or of methacrylic acid ester based (co)polymers, and water-soluble aminoalkyd based resins. These may be employed individually or in combination.

Methods, in which the pattern in color filters is formed employing said non-photosensitive colored compositions, include a method which directly prints said colored pattern onto a substrate employing a color filter printing ink based on various kinds of said printing methods, a method in which said colored pattern is formed on a substrate employing a water-soluble electrodeposition coating composition for said color filter based on electrodeposition coating, and a method in which by employing an electronic printing method and an electrostatic printing method, or after temporarily forming a colored pattern on a transfer base material employing said methods, said colored pattern is transferred onto the substrate for the color filter. Subsequently, if desired, baking is carried out based on conventional methods, and in order to result in a smoothened surface, polishing is carried out, and in order to protect the surface, top coating is also carried out. Further, a black matrix is formed based on conventional methods whereby RGB (Red, Green and Blue) color filters are prepared.

EXAMPLES

The present invention will now be specifically described with reference to examples. However, the present invention is not limited to these examples.

Example 1-1

(Preparation of Ink)

The raw materials described below were blended and ink comprised of a uniform solution containing the dye of the present invention was prepared. The solubility of said dye was excellent and said dye exhibited excellent compatibility with the resultant ink.

| | |
|---|---|
| Exemplified Compound 1 | 0.72 g |
| Polyvinyl acetoacetal resin (KY-24, manufactured by Denki Kagaku Kogyo Co.) | 1.08 g |
| Methyl ethyl ketone | 26.4 ml |
| Toluene | 1.6 ml |

(Preparation of Dye Providing Materials)

Said ink was applied onto a 4.5 $\mu$m thick polyethylene terephthalate (PET) base employing a wire bar so as to obtain a coating weight of 2.3 g/m$^2$ after drying and was subsequently dried, whereby Dye Providing Material 1 comprising said PET film having thereon a dye providing layer was prepared. Further, on the rear surface of said PET base, a nitrocellulose layer comprising a silicone-modified urethane resin (SP-2105, manufactured by Dainichi Seika Co.) was provided as a sticking resistant layer.

Dye Providing Materials 2 through 12 were prepared in the same manner as Example 1, except that the dye was replaced with those shown in Table 1.

(Preparation of Image Receiving Materials)

A coating composition, having the composition described below, was applied onto a support (in one polyethylene layer, a white pigment (titanium dioxide) and bluing agents are included) prepared by laminating polyethylene onto both sides of a paper sheet so as to obtain a coated weight of 7.2 g after drying and subsequently is dried, whereby Image Receiving Layer 1 was prepared.

| | |
|---|---|
| Metal ion containing compound (MS-1) | 4.0 g |
| Polyvinyl butyral resin (BX-1, manufactured by Sekisui Kagaku Kogyo Co.) | 6.0 g |
| Polyester modified silicone | 0.3 g |

MS-1 (Metal Ion Containing Compound)

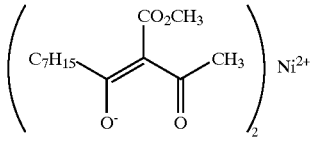

Further, Image Receiving Material 2, which comprised no metal ion containing compounds, was prepared in the same manner as Image Receiving Material 1, except that MS-1 was removed from said Image Receiving Material 1.

(Thermal Transfer Recording)

Said dye providing material faced said image receiving material, and image recording was carried out employing a thermal printer while touching the thermal head onto the rear surface of said dye providing material, whereby Images 1 through 20, which exhibited excellent gradation, were prepared.

The maximum density of the resultant images, the sensitivity of recording materials, image retaining properties, and color reproduction were evaluated based on the criteria described below.

<<Maximum Density>>

The maximum reflection density of the image (generally the reflection density of the part of the maximum applied time) was determined employing a densitometer, X-Rite 310TR (manufactured by X-Rite Co.).

<<Sensitivity>>

The applied energy value to obtain a density of 1.0 of Image 21 formed employing Dye Providing Material 13 and Image Receiving Material 1 was defined as 1. Then the relative applied energy of each recording material was calculated based on the above-mentioned standard. The smaller the figure, the higher the resulting sensitivity.

<<Light Fastness>>

Light fastness was represented by a residual dye ratio after the resultant image was irradiated for 14 days employing a xenon fade meter. Incidentally, said residual dye ratio was represented by $(D/D_0)\times 100$, wherein Do represents the density prior to light irradiation and D represents the density after said light irradiation.

<<Color Reproduction>>

The color of the resultant cyan image was visually evaluated. The evaluation was carried out based on a 5-grade evaluation number 1 through 5. The larger the figure, the higher the evaluation.

Table 1 shows the results.

TABLE 1

| Image No. | Dye Providing Material | Image Receptive Material | Dye (Exemplified Compound) | Maximum Density | Sensitivity | Light Fastness (in %) | Color Reproduction |
|---|---|---|---|---|---|---|---|
| 1 | 1 | 1 | Exemplified 3 | 2.59 | 0.82 | 82.5 | 3 |
| 2 | 1 | 2 | Exemplified 3 | 2.48 | 0.73 | 71.8 | 3 |
| 3 | 2 | 1 | Exemplified 5 | 2.61 | 0.85 | 83.3 | 3 |
| 4 | 2 | 2 | Exemplified 5 | 2.47 | 0.74 | 72.6 | 3 |
| 5 | 3 | 1 | Exemplified 12 | 2.60 | 0.85 | 81.7 | 3 |
| 6 | 3 | 2 | Exemplified 12 | 2.51 | 0.76 | 71.1 | 3 |
| 7 | 4 | 1 | Exemplified 14 | 2.60 | 0.77 | 85.9 | 4 |
| 8 | 4 | 2 | Exemplified 14 | 2.53 | 0.77 | 75.3 | 4 |
| 9 | 5 | 1 | Exemplified 18 | 2.60 | 0.79 | 86.5 | 4 |
| 10 | 6 | 1 | Exemplified 19 | 2.64 | 0.79 | 88.8 | 4 |
| 11 | 6 | 2 | Exemplified 19 | 2.55 | 0.71 | 76.7 | 4 |
| 12 | 7 | 1 | Exemplified 21 | 2.55 | 0.76 | 87.8 | 3 |
| 13 | 8 | 2 | Exemplified 21 | 2.46 | 0.68 | 75.6 | 3 |

TABLE 1-continued

| Image No. | Dye Providing Material | Image Receptive Material | Dye (Exemplified Compound) | Maximum Density | Sensitivity | Light Fastness (in %) | Color Reproduction |
|---|---|---|---|---|---|---|---|
| 14 | 8 | 1 | Exemplified 22 | 2.70 | 0.73 | 90.3 | 5 |
| 15 | 9 | 2 | Exemplified 22 | 2.63 | 0.69 | 81.1 | 5 |
| 16 | 10 | 1 | Exemplified 24 | 2.68 | 0.72 | 87.4 | 4 |
| 17 | 10 | 1 | Exemplified 27 | 2.77 | 0.71 | 91.2 | 5 |
| 18 | 11 | 2 | Exemplified 27 | 2.67 | 0.68 | 82.5 | 5 |
| 19 | 12 | 1 | Exemplified 31 | 2.65 | 0.71 | 86.9 | 4 |
| 20 | 12 | 2 | Exemplified 31 | 2.54 | 0.66 | 77.3 | 4 |
| 21 | 13 | 1 | Comparative 1 | 2.21 | 1.00 | 76.5 | 2 |
| 22 | 13 | 2 | Comparative 1 | 2.35 | 0.88 | 66.4 | 2 |
| 23 | 14 | 1 | Comparative 2 | 2.38 | 0.95 | 73.2 | 2 |
| 24 | 14 | 2 | Comparative 2 | 2.21 | 0.82 | 65.3 | 2 |
| 25 | 15 | 1 | Comparative 3 | 2.24 | 0.91 | 71.8 | 3 |
| 26 | 15 | 2 | Comparative 3 | 2.19 | 0.86 | 60.1 | 3 |

Comparative Compound 1

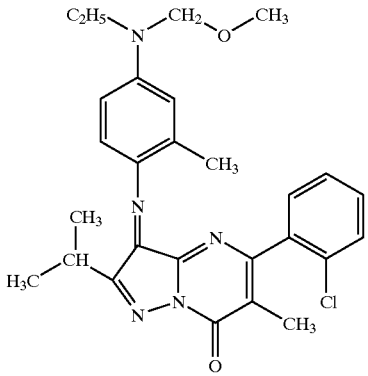

Comparative Compound 2

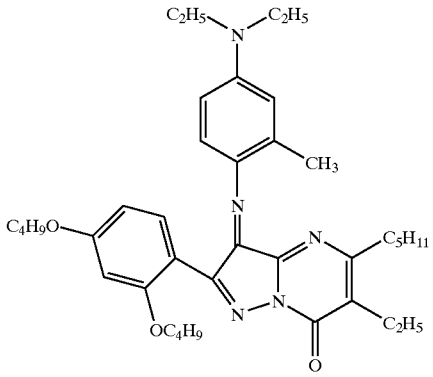

Comparative Compound 3

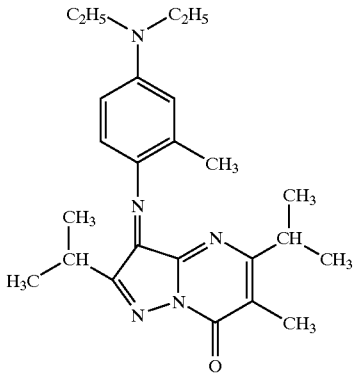

As is shown in Table 1, thermal transfer recording materials employing the dyes of the present invention exhibit high sensitivity and forming images of high density and excellent color reproduction. And further, light fastness can be increased by using the thermal transfer recording method of the present invention.

Example 2

Ink Jet Recording Ink

An acetone solution of said Exemplified Compound 27 and another acetone solution of metal ion containing compound MS-1 of said Example 1 were prepared. Subsequently, both solutions were mixed so as to obtain a molar ratio of Exemplified Compound 27: MS-11:5, and the resultant mixture was concentrated. The resultant concentrate was designated as a chelate dye.

Ink Composition I-1, having the composition described below, was prepared employing said chelate dye through a conventional method. Further, Ink Composition I-2 was prepared in the same manner as Ink Composition I-1, except that copper phthalocyanine compound C, described below, was used as a cyan dye.

(Composition of Ink Composition I-1)

| | |
|---|---|
| Cyan dye: chelate dye | 1.4% by weight |
| Diethylene glycol | 19% by weight |
| Trimethylene glycol monobutyl ether | 9% by weight |
| Surface active agent Surfynol 465 (manufactured by Air Products and Chemicals, Inc.) | 0.6% by weight |
| Deionized water | 70% by weight |

Surfynol 465

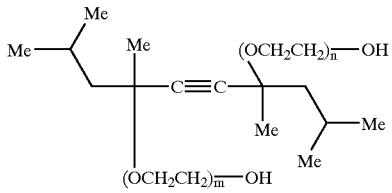

(m + n = 10)

-continued

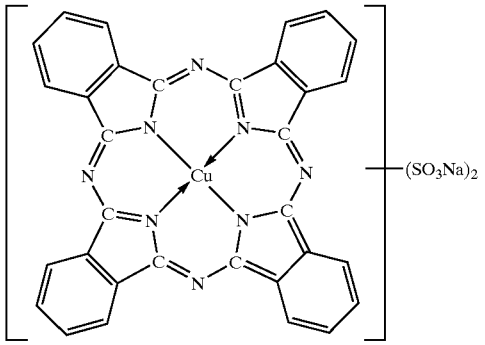

Cooper Phthalocyanine Compound C

Printing was carried out onto special ink jet paper, Super Fine Special Paper MJSP1 (manufactured by Seiko Epson Corp.), employing ink jet printer MJ-5000C (employing the electrical-mechanical conversion system, manufactured by Seiko Epson Corp.) in which the resultant Ink Composition I-1 or I-2 was used. Subsequently, the resultant samples were visually evaluated. The sample, which had been prepared employing Ink Composition I-1 comprising the compound of the present invention, was a bright cyan. On the other hand, the sample, which had been prepared employing Ink Composition I-2, exhibited insufficient chroma and approached undesired blue. When, instead of said Super Fine Special Paper MJSP1, Special Glossy Film MJSP4 (manufactured by Seiko Epson Corp.) was employed as a recording medium, the same results as above were obtained. As noted, it is possible to prepare recording images of excellent color employing an ink jet recording ink in which the compounds of the present invention are employed as metal chelate dyes.

Example 3

Color Toner

A chelate dye was prepared in the same manner as said Example 2, employing Exemplified Compound 27 and a metal ion containing compound MS-1. One hundred weight parts of polyester resin, the parts described below as a colorant, and 3 parts of polypropylene were blended, kneaded, pulverized, and classified, whereby a powder having an average particle diameter of 8.5 $\mu$m was prepared. Further, 100 parts of the resultant powder and 1.0 part of fine silica particles (having a particle diameter of 12 nm and a degree of hydrophobicity of 60) were blended employing a Henschel mixer, whereby Color Toner Nos. 30 through 33 were prepared.

Addition Parts of Colorant Cyan Chelate Dye: 2 parts

Comparative Pigment or Dye: 3 parts

<Preparation of Carrier>

Charged into a high speed stirring type blender were 40 g of fine styrene/methyl methacrylate=6/4 copolymer particles and 1,960 g of Cu—Zn ferrite particles having a specific gravity of 5.0, a weight average diameter of 45 $\mu$m, and a saturation magnetization of 25 emu when a 1,000 oersted external magnetic field was applied. Subsequently, the resultant mixture was blended at a material temperature of 30° C. for 15 minutes. Thereafter, the material temperature was set at 105° C., and a mechanical force was repeatedly applied to the resultant mixture for 30 minutes, which was then cooled to prepare a carrier.

<Preparation of Developer>

A developer for practical imaging tests was prepared by blending 418.5 g of said carrier and 31.5 g of each toner for 20 minutes employing a V type blender.

<<Evaluation Apparatus and Conditions>>

In the example, practical imaging evaluation was carried out employing Konica 9028 (manufactured by Konica Corp.) as an image forming apparatus.

<<Evaluation Items and Evaluation Methods>>

Tests were carried out in such a manner that reflective images (images on a paper sheet) and transparent images (images for OHP) were prepared employing the developer comprising the color toner of the present invention, based on said image forming method. The resultant samples were evaluated based on the methods described below. Incidentally, the evaluation was carried out in the range of a toner adhesion amount of 0.7±0.05 mg/cm$^2$.

Chroma:

The chroma of the resultant image on a paper sheet was determined employing Macbeth Color-Eye 7000 and then compared.

Light Fastness:

The resultant sample was irradiated for 7 days employing "Xenon Long Life Weather Meter" (having a xenon arc lamp of 70,000 lux and at 44° C.) manufactured by Suga Shikenki Sha. Subsequently, the color difference prior to and after said irradiation was determined employing said Macbeth Color-Eye 7000, and compared.

Transparency:

The transparency of the OHP image was evaluated employing the method described below. The spectral transmittance of the image in the visible range was determined employing "330 Type Automatic Recording Spectrophotometer", manufactured by Hitachi Seisakusho while utilizing an OHP sheet bearing no toner as a reference, and spectral transmittance at yellow 570 nm, magenta 650 nm and cyan 500 nm was determined and designated as the scale of the transparency of the OHP images.

Color Variation:

Color difference of the resultant image on the paper sheet and the OHP film was determined employing Macbeth Color-Eye 7000.

<<Evaluation Results>>

Table 2 shows the results.

TABLE 2

| Sample No. | Dye | Chroma | Light Fastness | Transparency | Color Variation |
|---|---|---|---|---|---|
| 30 | Chelate Dye 1 | 61.4 | 0.1 | 89.7 | −7.3 |
| 31 | C. I. Pigment Blue 1 | 55.8 | 2.4 | 70.3 | −22.4 |
| 32 | C. I. Solvent Blue Blue 1 | 50.0 | 7.0 | 85.6 | −36.7 |
| 33 | C. I. Solvent Blue Blue 1 | 48.4 | 8.2 | 84.4 | −12.5 |

As can clearly be seen from Table 2, faithful color reproduction and high OHP quality are exhibited when employing color toners prepared employing the compound of the present invention, resulting in the color toners of the present invention are suitable for use as full color toners. Further, since the light fastness is excellent, it is possible to provide images capable of being stored for an extended period of time.

Example 4

Color Filters

A chelate dye was prepared in the same manner as Examples 2 and 3, employing Exemplified Compound 27 and metal ion containing Compound MS-1. In order to prepare a RBG color filter, a red (R) mosaic pattern, a green (G) mosaic pattern, and a blue (B) mosaic pattern were formed on a glass plate, employing the method described below. A red (R), a green (G), and a (B) coating compositions were prepared employing the components described below. The employed photosensitive polyimide resinous varnish is one comprising optical sensitizers.

Components of Photosensitive Coating Composition for Color Filter

| | |
|---|---|
| R1: | |
| Chelate dye | 10 parts |
| Photosensitive polyimide resinous varnish | 50 parts |
| N-methyl-2-pyrrolidone | 40 parts |
| G-1: | |
| Colorant G-1 | 10 parts |
| Photosensitive polyimide resinous varnish | 50 parts |
| N-methyl-2-pyrrolidone | 40 parts |
| B-1: | |
| Colorant B-1 | 10 parts |
| Photosensitive polyimide resinous varnish | 50 parts |
| N-methyl-2-pyrrolidone | 40 parts |

Colorant G-1 (colorant for a green filter) (compound described in Japanese Patent Publication No. 11-158094)

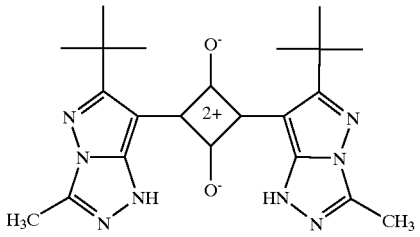

Colorant B-1 (colorant for a blue filter) (compound described in Japanese Patent Publication No. 11-158094)

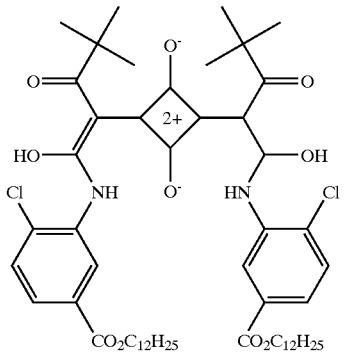

A glass plate, which had been subjected to a silane coupling agent treatment, was set on a spin coater, and said photosensitive coating composition for R-1 red color filter was initially spin-coated at 300 rpm for 5 seconds and subsequently 2,000 rpm at 5 seconds. Subsequently, pre-baking was carried out at 80° C. for 15 minutes and a mosaic pattern photomask was brought into close contact.

Thereafter, exposure was carried out employing an ultra-high pressure mercury arc lamp at a light intensity of 900 mJ/cm$^2$. Subsequently, development was carried out employing a special developer, and washing was carried out employing a special rinse, whereby a red mosaic pattern was formed on said glass plate. Subsequently, a green mosaic pattern and a blue mosaic pattern were also prepared by coating said photosensitive coating compositions for G-1 and B-1 color filters based on said method and were subjected to printing. Thereafter, a black matrix was formed employing a conventional method, whereby an RGB color filter was prepared. The color filter prepared as above exhibits excellent spectral absorption characteristics and excellent durability such as excellent light fastness and heat resistance, and further exhibits excellent light transmittance. As a result, said color filter exhibits excellent quality as a color filter for liquid crystal color display.

Further, when the chelate dye, which is prepared in the same manner as above employing Exemplified Compound 22 instead of said combination, the same results were obtained.

The thermal transfer recording material according to the present invention and the thermal transfer recording method employing said recording method are capable of preparing images which make it possible to achieve high sensitivity recording, exhibit preferred color without undesired absorption in terms of color reproduction, and exhibit excellent image retaining quality such as excellent light fastness. Further, by employing chelate dyes formed between the compounds of the present invention and metal ion containing compounds, it is possible to prepare ink jet recording ink which exhibits excellent color. Further by employing said chelate dyes, it is possible to prepare color toners which exhibit excellent properties as a full-color toner, such as faithful color reproduction and high OHP quality, and in addition, exhibit high image retaining properties. Still further, by employing said chelate dyes, it is possible to prepare color filters which exhibit excellent spectral absorption properties, high durability, and excellent light transmittance.

What is claimed is:

1. A thermal transfer recording material comprising a support having thereon an image transferring layer containing a coloring material represented by Formula (II), Formula (II):

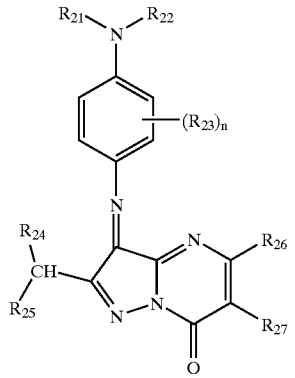

wherein each $R_{21}$ and $R_{22}$ is independently a substituted or unsubstituted aliphatic group; $R_{23}$ is a substituent and n is an integer of 0 to 4, provided that when n is 2 or more, a plurality of $R_{23}$s are the same or different; $R_{24}$ and $R_{25}$ each are an alkyl group; $R_{26}$ is a branched chain alkyl group; and $R_{27}$ is an alkyl group other than methyl group.

2. The thermal transfer recording material of claim 1, wherein $R_{26}$ is a branched chain alkyl group having 3 to 8 carbon atoms.

3. The thermal transfer recording material of claim 1, wherein the coloring material represented by Formula (II) has a molecular weight of 400 to 500.

4. A thermal transfer recording method, comprising the steps of:

(a) superimposing an image receiving material onto a thermal transfer recording material comprising a support having thereon an image transferring layer containing a coloring material represented by Formula (II), (b) applying heat onto the thermal transfer recording material to form an image; and (c) separating the thermal transfer recording material and the image receiving material from each other, Formula (II):

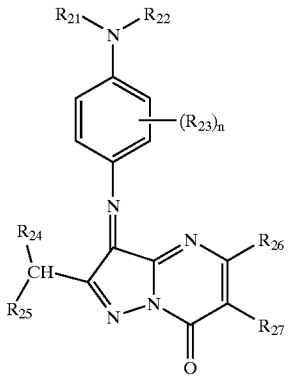

wherein each $R_{21}$ and $R_{22}$ is independently a substituted or unsubstituted aliphatic group; $R_{23}$ is a substituent and n is an integer of 0 to 4, provided that when n is 2 or more, a plurality of $R_{23}$s are the same or different; $R_{24}$ and $R_{15}$ each are an alkyl group; $R_{26}$ is a branched chain alkyl group; and $R_{27}$ is an alkyl group other than methyl group.

5. The thermal transfer recording method of claim 4, wherein the image receiving material comprises a support having thereon a layer containing a compound comprising a metal ion capable of forming a metal complex dye with the coloring material in the thermal transfer recording material during the step (b).

6. An ink for ink jet printing, which comprises a metal complex dye prepared from a compound containing a metal ion and a coloring material represented by (II)

Formula (II):

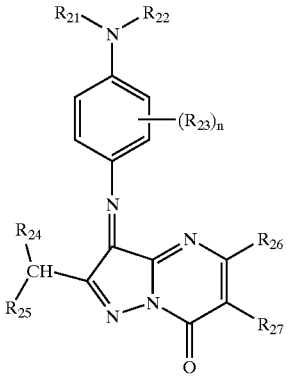

wherein each $R_{21}$ and $R_{22}$ is independently a substituted or unsubstituted aliphatic group; $R_{23}$ is a substituent and n is an integer of 0 to 4, provided that when n is 2 or more, a plurality of $R_{23}$s are the same or different; $R_{24}$ and $R_{25}$ each are an alkyl group; $R_{26}$ is a branched chain alkyl group; and $R_{27}$ is an alkyl group other than methyl group.

* * * * *